US010865603B2

(12) United States Patent
Park

(10) Patent No.: US 10,865,603 B2
(45) Date of Patent: Dec. 15, 2020

(54) CORE DRILL APPARATUS FOR INSTALLATION IN EXCAVATOR

(71) Applicant: Jae-Mun Park, Cheongju-si (KR)

(72) Inventor: Jae-Mun Park, Cheongju-si (KR)

( * ) Notice: Subject to any disclaimer, the term of this patent is extended or adjusted under 35 U.S.C. 154(b) by 274 days.

(21) Appl. No.: 15/554,040

(22) PCT Filed: Feb. 26, 2016

(86) PCT No.: PCT/KR2016/001959

§ 371 (c)(1),
(2) Date: Aug. 28, 2017

(87) PCT Pub. No.: WO2016/137289

PCT Pub. Date: Sep. 1, 2016

(65) Prior Publication Data

US 2018/0038165 A1 Feb. 8, 2018

(30) Foreign Application Priority Data

Feb. 27, 2015 (KR) ..... 20-2015-0001294

(51) Int. Cl.
*E21B 7/02* (2006.01)
*E21B 10/02* (2006.01)
(Continued)

(52) U.S. Cl.
CPC ..... *E21B 7/024* (2013.01); *E02F 5/20* (2013.01); *E02F 5/30* (2013.01); *E21B 7/028* (2013.01);
(Continued)

(58) Field of Classification Search
CPC ..... E21B 7/024; E21B 7/028; E02F 9/261
See application file for complete search history.

(56) References Cited

U.S. PATENT DOCUMENTS 1,896,105 A * 2/1933 Simmons ..... E21B 4/06 173/125
8,485,288 B2 * 7/2013 Kaethner ..... B62D 55/084 180/9.46
(Continued)

FOREIGN PATENT DOCUMENTS

KR 20-0361015 9/2004
KR 20-0384177 5/2005
(Continued)

OTHER PUBLICATIONS

English Specification of 10-0555043
(Continued)

*Primary Examiner* — Giovanna Wright
*Assistant Examiner* — Yanick A Akaragwe
(74) *Attorney, Agent, or Firm* — Antonio Ha & U.S. Patent, LLC

(57) ABSTRACT

The present invention relates to a core drill apparatus which is mounted to a working boom of an excavator so as to drill rock or a concrete structure and, more particularly, to a core drill apparatus for installation in an excavator, which comprises a ring gear and a plurality of elevation cylinders that are connected to and installed in a working support frame mounted to the end of a working boom of an excavator so as to rotate the working support frame, and at the same time, is configured to support the working frame while adjusting the height of the slope using the elevation cylinders when the working frame is supported on an inclined work surface. Therefore, the present invention enables a drilling bit provided in the working support frame to stably drill a structure regardless of the inclination of a work surface to be drilled, and can thus significantly improve the efficiency of a drilling operation.

3 Claims, 8 Drawing Sheets

(51) Int. Cl.

| | |
|---|---|
| ***E02F 5/30*** | (2006.01) |
| ***E21B 25/00*** | (2006.01) |
| ***E02F 5/20*** | (2006.01) |
| *E02F 3/36* | (2006.01) |
| *E02F 9/26* | (2006.01) |

(52) U.S. Cl.
CPC ..... *E21B 10/02* (2013.01); *E21B 25/00* (2013.01); *E02F 3/3604* (2013.01); *E02F 9/261* (2013.01)

(56) References Cited

U.S. PATENT DOCUMENTS

2004/0238068 A1* 12/2004 Duval ..... A01G 23/097 144/24.13
2010/0196129 A1* 8/2010 Buckner ..... E02F 3/8825 414/467

FOREIGN PATENT DOCUMENTS

| | | |
|---|---|---|
| KR | 20-0401983 | 11/2005 |
| KR | 100555043 B1 * | 2/2006 |
| KR | 10-0555043 | 3/2006 |
| KR | 10-0580080 | 5/2006 |
| KR | 20-0478234 | 9/2015 |

OTHER PUBLICATIONS

English Specification of 20-0384177.
English Specification of 20-0401983.
English Specification of 20-0361015
English Specification of 10-0580080.
English Specification of 20-0478234.

* cited by examiner (a)

(b)

<a>

<b>

<a>

<b>

CORE DRILL APPARATUS FOR INSTALLATION IN EXCAVATOR

CROSS-REFERENCE TO RELATED APPLICATIONS

This patent application is a national-stage application of PCT/KR2016/001959 filed on Feb. 26, 2016 which claims priority under 35 U.S.C. § 119 to Korean Utility Model Application No. 20-2015-0001294, filed on Feb. 27, 2015, in the Korean Intellectual Property Office, the disclosures of which are incorporated by reference herein in their entireties.

TECHNICAL FIELD

The present invention relates to a core drill apparatus that is installed in the boom of an excavator to drill into rock or a concrete structure, and more specifically, a core drill apparatus for installation in an excavator above, wherein a ring gear and multiple elevating cylinders are connected and installed in a work supporting frame which is mounted to an end of the boom of the excavator to rotate the work supporting frame while adjusting the height on the inclined work surface by expanding or contracting the elevating cylinders when supporting the work supporting frame on the inclined work surface, allowing a drill bit provided in the work supporting frame to stably drill into the structure regardless of the slope of the work surface on which the drilling is done, and significantly enhancing the work efficiency of drilling.

DISCUSSION OF RELATED ART

Vibratory hammer drills are typically utilized in various construction sites, e.g., to drill into rock or concrete structure or dismantle concrete structures. However, the use of such drills may cause severe vibrations and noise, harming the workers, retarding the work process, and deteriorating work efficiency.

Various construction sites sometimes need to crack rock or concrete structures or measure the thickness of a concrete structure to test the robustness of the structure. For such purposes, drilling machines are required.

A representative example of such drilling machine is a hydraulic core drill that is provided with a core tube to be ascended or descended between a pair of supporting plates installed in an excavator, a pair of guide rods vertically provided between the supporting plates to guide the core tube to ascend or descend, and a drill bit coupled to the bottom of the core tube to be rotated by a hydraulic motor.

The operation of such conventional hydraulic core drill having such configuration is described. After the hydraulic core drill is installed in an excavator, the core tube is ascended through the cylinder, and in this state, the drill bit is coupled to the bottom of the core tube. Then, the core tube and the drill bit are descended to allow the drill bit to contact the surface of the rock or concrete structure. Then, the hydraulic motor is driven to rotate the core tube and the drill bit while gradually descending the piston rod of the cylinder. Thus, the drill bit may drill a predetermined diameter of hole in the rock or concrete structure.

In the conventional hydraulic core drill, however, the cylinder for ascending the core tube and the drill bit projects beyond the top of the upper plate, spoiling the overall outer look of the machine. Further, the cylinder that projects externally may easily be damaged. In particular, the overall length of the drill is increased, rendering it difficult to manufacture or handle.

To resolve such problems, a few techniques have been proposed which ascend the core tube and drill bit using an elevation chain and a chain driving motor instead of the cylinder.

Such techniques allows the hydraulic core drill a better look in more compact size and a more simple way to produce. These techniques also prevent each part from unnecessary contact or external impacts. Thus, the parts may be less likely to be damaged and more likely to present an increased lifespan with increased durability.

However, these techniques or other conventional hydraulic core drills is silent as to a means for adjusting the speed of the chain driving motor, thus failing to vary the speed at which the core tube descends depending on the strength of the rock or concrete structure. Thus, the conventional drills may be easily broken. Further, they do not present a means for preventing the core tube from excessively moving up or down. Thus, according to the conventional art, the core tube may be excessively ascended or descended due to a malfunction of the chain driving motor, and may resultantly be broken and its lifespan may be reduced.

Korean Utility Model Registration No. 20-0478234, issued to the inventor of the instant application, discloses a 'core drill apparatus for installation in an excavator,' which addresses the above issues.

The inventor's 'core drill apparatus for installation in an excavator' is configured to be able to minimize the number of workers and simplify the work by allowing the operator to control the operation (rotation speed and rotation direction) of the elevation driving motor for ascending or descending the drill bit through a control panel installed in the operator's cab of the excavator in a simple and automated manner.

PRIOR ART DOCUMENTS

Patent Documents (Patent Document 1) Korean Utility Model Registration No. 20-0478234 registered on Sep. 3, 2015

(Patent Document 2) Korean Utility Model Registration 20-0361015 registered on Aug. 26, 2004

(Patent Document 3) Korean Utility Model Registration 20-0384177 registered on May 3, 2005

SUMMARY

However, the 'core drill apparatus for installation in an excavator' has a limit in the range of work of the work supporting frame that is mounted onto an end of the boom of the excavator, and the rotational force of the drill bit when drilling is performed on an inclined work surface may be overburdened, deteriorating work efficiency.

Further, in the conventional apparatus, after one session of drilling and when doing another at a changed angle, the bolts and nuts in the portion connected to the excavator are loosened before changing the angle, and are then fastened together back. This process takes too long, requires an assistant worker, and may cause a change in position while changing the angle.

Further, when drilling is performed in a dark underground area which is far away from the operator's cab, assistant personnel need to be positioned around the work site to notify the operator how the work is going. This may result in some safety issues, failure to exactly proceed to work, a delay in work, deterioration of work efficiency, and rise in costs.

Further, the conventional apparatus may cause dust to fly around when drilling into rock or a concrete structure, rendering it difficult for the operator to exactly check the work process. Thus, the work accuracy and efficiency may be deteriorated.

The present invention has been conceived to address the foregoing issues.

An object of the present invention is to provide a core drill apparatus for installation in an excavator, in which a work supporting frame mounted to an end of the boom of an excavator may be rotated at 360 degrees through a ring gear and a motor so that, after one drilling session is done and when performing another, the angle may easily be changed, thus eliminating the need for separate assistant workers and reducing the work time.

Another object of the present invention is to provide a core drill apparatus for installation in an excavator, in which multiple elevating cylinders that are ascended or descended in different distances are connected and installed in the work supporting frame to support the work supporting frame on an inclined work surface by adjusting the height using the elevating cylinders so that the work supporting frame can be fastened in tight contact with the work surface regardless of the degree of slope of the work surface, allowing the drill bit provided in the work supporting frame to stably drill into the structure, significantly enhancing the work efficiency of drilling.

Still another object of the present invention is to provide a core drill apparatus for installation in an excavator, in which a lighting device-equipped camera is provided in the work supporting frame having the drill bit therein to enable the work process to be displayed on the monitor screen in the operator's cab, allowing the operator to easily check the work process even in a dark work environment.

Yet still another object of the present invention is to provide a core drill apparatus for installation in an excavator, which can jet water to the inside and outside of the work surface, getting rid of dust when drilling, allowing the worker to easily check the work process.

To achieve the above objects, according to the present invention, there is provided a core drill apparatus for installation in an excavator, comprising a mount having a side portion detachably mounted on an end portion of a boom of the excavator, a support mounted and fastened to an opposite side portion of the mount, including an upper frame, a lower frame, and supporting frames connecting the upper frame with the lower frame in an upper or lower direction, and formed in a rectangular box structure having, at least, an opened top and an opened bottom, an elevator including a pair of elevation guide poles passing through the support and an elevation driving motor mounted on a side of the support, wherein the pair of elevation guide poles are provided in parallel with the supporting frames and have an upper portion coupled to the upper frame and a lower portion coupled to the lower fame; an elevation block ascended or descended along the elevation guide poles by an operation of the elevation driving motor, and a drilling part including a rotational driving motor mounted in the elevation block and a drill bit coupled with a driving shaft of the rotational driving motor to be rotated by the rotational driving motor, wherein the mount includes a boom coupler formed in an end thereof to connect to the boom of the excavator and a rotational coupler formed in an opposite end thereof to rotatably connect to the support, wherein a plurality of elevating cylinders are coupled to their respective corresponding supporting frames of the support to be ascended or descended along an inclined surface of a work surface for drilling to be brought in tight contact with the work surface, and wherein a plurality of hydraulic lines branched from a hydraulic hose are provided on the elevating cylinders.

According to the present invention, the core drill apparatus for installation in an excavator may rotate the work supporting frame, which has the drill bit, at 360 degrees. Thus, an easier angle change is possible after completing one drilling session and when doing another. Therefore, no separate assistant personnel are required, and the work time may be reduced.

Further, according to the present invention, when the work supporting frame is supported on an inclined work surface, it may be brought in tight contact with the work surface by the elevating cylinders, which are separately moved, regardless of the condition of the work surface. Thus, the drill bit in the work supporting frame may stably drill into the structure despite the slope of the work surface. Therefore, the efficiency of the drilling work is significantly enhanced.

Further, according to the present invention, the plurality of hydraulic lines branched from one hydraulic hose are connected to their respective elevating cylinders, allowing the plurality of elevating cylinders to be simultaneously driven by a single operation. Multiple such hydraulic hoses are provided to shorten the time taken for each elevating cylinder to tightly contact the work surface.

Further, according to the present invention, the camera with a lighting device is installed in the work supporting frame having the drill bit therein, allowing the work process to be checked on the screen in the operator's cab. Further, the sprays are provided to jet water to the work surface. Thus, although the work site is positioned far away from the operator's cab, the operator can exactly check the work process without help from a separate assistant worker, saving work costs and time and significantly enhancing work environment.

DETAILED DESCRIPTION OF EXEMPLARY EMBODIMENTS

Hereinafter, preferred embodiments of the present invention are described with reference to the accompanying drawings to be easily practiced by one of ordinary skill in the art to which the present invention pertains.

According to the present invention, a core drill apparatus 100 for installation in an excavator is shown in FIGS. 1 to 10.

Figure 1:
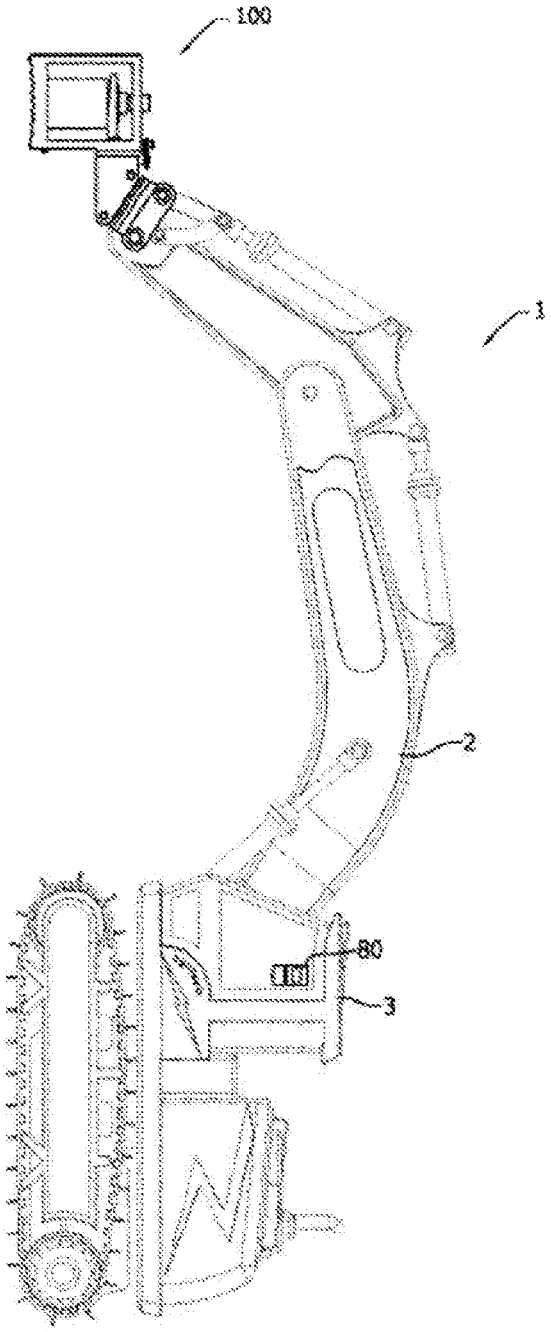
FIG. 1 is a view illustrating a core drill apparatus for installation in an excavator according to an embodiment of the present invention.

FIG. 1 is a view illustrating a ring gear-equipped core drill apparatus for installation in an excavator, wherein the core drill apparatus is equipped in a boom of the excavator.

The core drill apparatus 100 for installation in an excavator is equipped in an end portion of a boom 2 where a work bucket (not shown) of the excavator is mounted.

In other words, the bucket is removed from the end portion of the boom 2, and the core drill apparatus 100 for installation in an excavator is then mounted and fastened.

Figure 2:
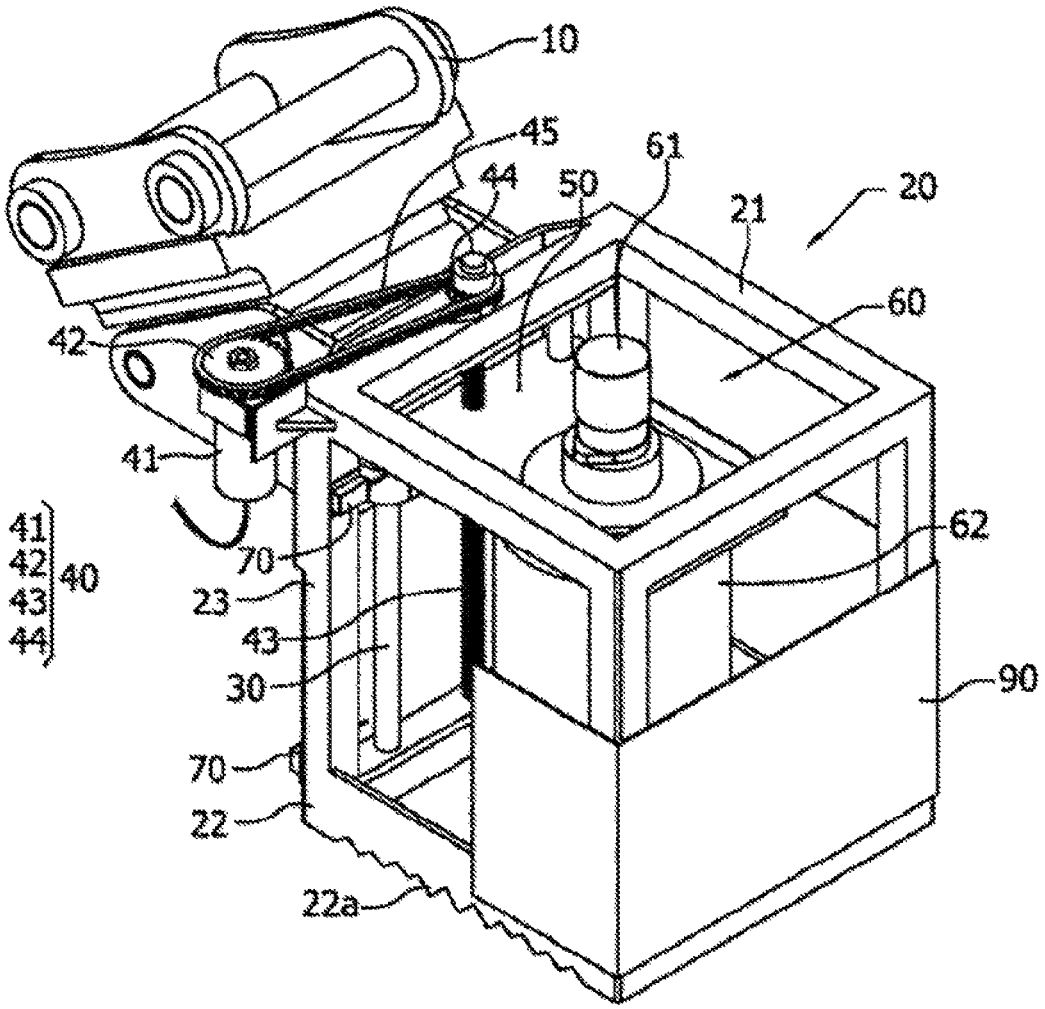
FIG. 2 is a front perspective view illustrating a core drill apparatus for installation in an excavator as shown in FIG. 1.
Figure 3:
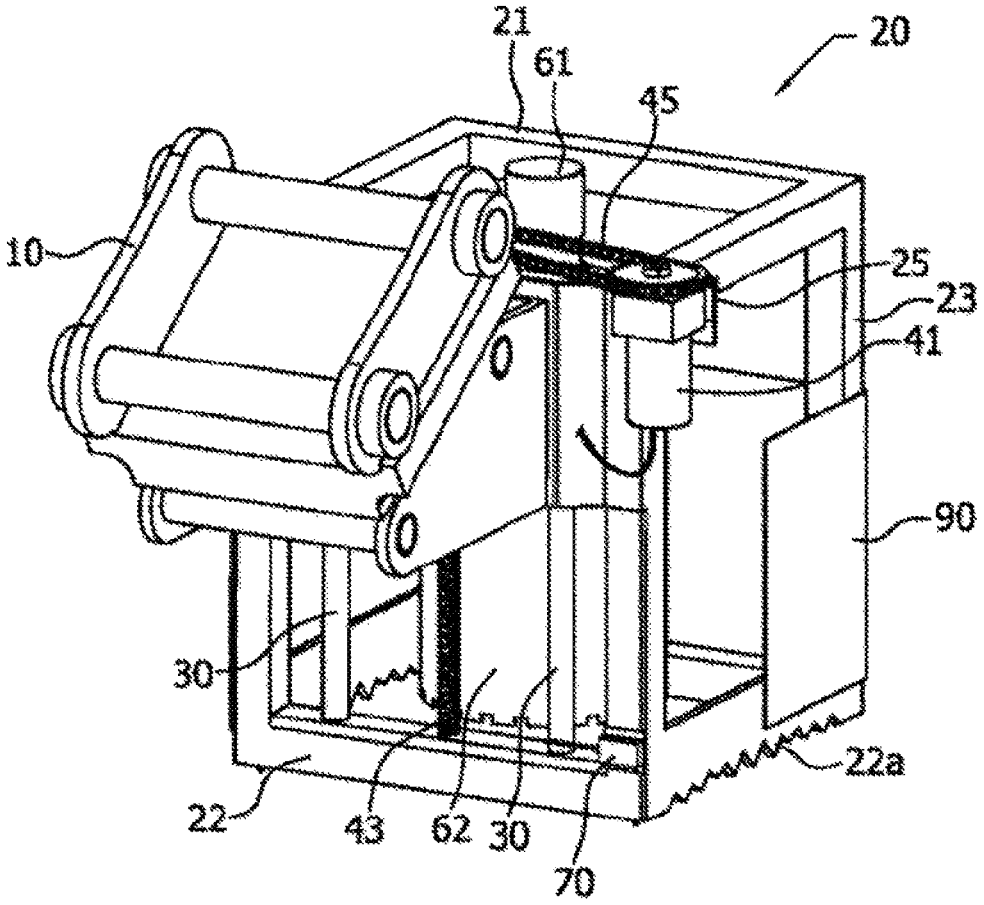
FIG. 3 is a rear perspective view illustrating a core drill apparatus for installation in an excavator as shown in FIG. 2.
Figure 4:
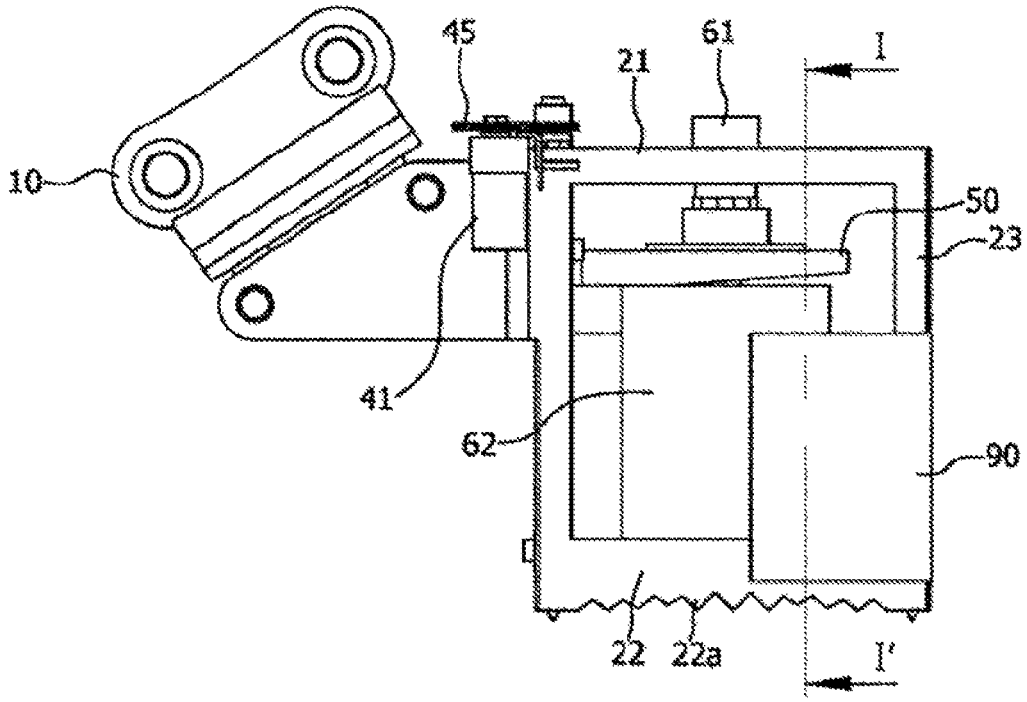
FIG. 4 is a side view illustrating a core drill apparatus as shown in FIG. 2.

FIG. 2 is a front perspective view illustrating a core drill apparatus 100 for installation in an excavator as shown in FIG. 1. FIG. 3 is a rear perspective view illustrating a core drill apparatus for installation in an excavator as shown in FIG. 2. FIG. 4 is a side view illustrating a core drill apparatus as shown in FIG. 2.

Referring to FIGS. 2 to 4, the core drill apparatus 100 for installation in an excavator includes a mount 10, a support 20, a pair of elevation guide poles 30, an elevator 40, an elevation block 50, a drilling part 60, limit switches 70, and a control panel 80.

The mount 10 is mounted so that a side portion of the mount 10 is detachably attached to an end portion of an excavator boom 2 (refer to FIG. 1).

The support 20 is mounted and fastened to an opposite side portion of the mount 10 as shown in FIGS. 2 and 3. The support 20 includes an upper frame 21, a lower frame 22, and supporting frames 23 connecting the upper frame 21 with the lower frame 22 in an upper-lower direction. The support 20 is formed in a box structure having, at least, an opened top and bottom. In this case, the lower frame 22 preferably has triangular protrusions 22*a* in its bottom for stable fastening to its floor rock or concrete structure, as shown in FIG. 4.

The mount 10 has a boom coupler 11 at an end thereof to couple and mount the excavator boom 2 and a rotational coupler 12 at an opposite end thereof to allow the support 20 to be rotatably connected.

The rotational coupler 12 includes a ring gear 13 to allow the support 20 to rotate and a ring gear driving motor 14 to drive to rotate forward or backward the ring gear 13.

Thus, as the ring gear driving motor 14 is driven, the ring gear 13 rotates, allowing the support 20 to rotate forward or backward.

In such a configuration, the support 20 is descended and supported on its floor surface, and the drilling part 60 is then descended to do drilling. Then, the support 20 is ascended while operating the ring gear 13 to rotate the support 20. Thus, easier drilling may be achieved even on a work surface perpendicular to the floor surface.

The pair of elevation guide poles 30 are installed in parallel with the supporting frames 23 as shown in FIGS. 2 and 3, and their upper portions are coupled to the upper frame 21 and their lower portions are coupled to the lower frame 22.

The elevator 40 includes an elevation driving motor 41, a main gear 42, a screw pole 43, a slave gear 44, and a belt or chain 45 to elevate the elevation block 50 as shown in FIGS. 2 and 3.

The elevation driving motor 41 is controlled by the control panel 80 to rotate forward or backward and is mounted on the upper frame 21 through a bracket 25 provided in a side portion of the upper frame 21.

The main gear 42 is coupled to the driving shaft of the elevation driving motor 41 to rotate in association with the operation of the elevation driving motor 41 to deliver a rotational force to the slave gear 44 through the belt or chain 45.

The screw pole 43 is provided in parallel with the pair of elevation guide poles 30 between the upper frame 21 and the lower frame 22, and its upper portion projects upwards through the upper frame 21.

The slave gear 44 is coupled to the upper portion of the screw pole 43 which projects upwards through the upper frame 21. The slave gear 44 is connected with the main gear 42 through the belt or chain 45 to deliver a rotational force from the main gear 42 through the belt or chain 45 to the screw pole 43.

The elevation block 50 is coupled to the pair of elevation guide poles 30 and the screw pole 43 as shown in FIGS. 2 and 4. The elevation block 50 is ascended or descended along the pair of elevation guide poles 30 and the screw pole 43 by the rotation of the screw pole 43 which is made as the elevation driving motor 41 is operated.

The drilling part 60 includes a rotational driving motor 61 mounted in the elevation block 50 and a drill bit 62 coupled to the driving shaft of the rotational driving motor 61 and rotated by the rotational driving motor 61 to drill a hole in the rock or concrete structure as shown in FIGS. 2 to 4. As the rotational driving motor 61, an oil hydraulic motor or electric motor may be used.

The limit switches 70 each are provided on an upper and lower portion, respectively, of one of the supporting frames 23 which is formed in the rear surface of the support 20 to sense a height at which the elevation block 50 ascends or descends.

As shown in FIG. 1, the control panel 80 is installed inside the operator's cab 3 of the excavator 1 to control the operation of the elevation driving motor 41 in response to the operation of the limit switches 70. The control panel 80 is preferably configured to control the driving of the ring gear driving motor 14.

Figure 5:
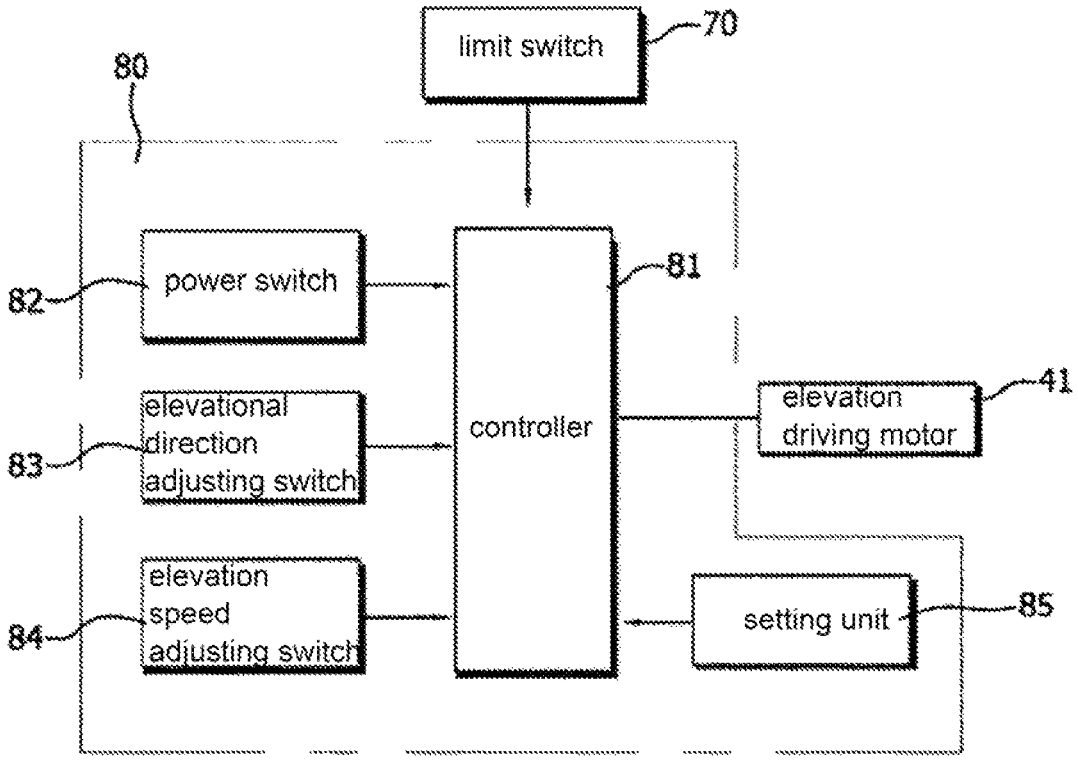
FIG. 5 is a block diagram illustrating an internal configuration of a control panel as shown in FIG. 1.

FIG. 5 is a block diagram illustrating an internal configuration of the control panel 80 shown in FIG. 1.

Referring to FIGS. 2 to 5, the control panel 80 includes a controller 81 that controls the operation of the elevation driving motor 41 in response to the operation of the limit switches 70, a power switch 82, an elevational direction adjusting switch 83 that selects a direction of rotation of the elevation driving motor 41 to adjust a direction in which the elevation block 50 ascends or descends, and an elevation speed adjusting switch 84 that adjusts the rotational speed of the elevation driving motor 41 to adjust the speed at which the elevation block 50 ascends or descends. The control panel 80 may further include a setting unit 85 to set the rotational speed of the elevation driving motor 41.

The controller 81 supplies power to the elevation driving motor 41 in response to the operation of the power switch 82 and selects the direction of rotation of the elevation driving motor 41 and adjusts the rotational speed of the elevation driving motor 41 in response to the operation of the elevational direction adjusting switch 83 and the elevation speed adjusting switch 84.

For example, when the elevation driving motor 41 rotates forward in response to the elevational direction adjusting switch 83, the elevation block 50 is ascended, and when the elevation driving motor 41 rotates backward in response to the elevational direction adjusting switch 83, the elevation block 50 is descended. The elevation driving motor 41 is rotated at a preset speed in response to the operation of the elevation speed adjusting switch 84, and the elevation block 50 is accordingly ascended or descended at a preset speed.

Meanwhile, the core drill apparatus 100 for installation in an excavator may further include an anti-flying debris cover 90 that is provided on the supporting frame 23 formed in the front part of the support 20 as shown in FIG. 2 to prevent rock fragments from scattering due to the rotational force of the drill bit 62 while drilling into the rock or concrete structure.

Figure 6:
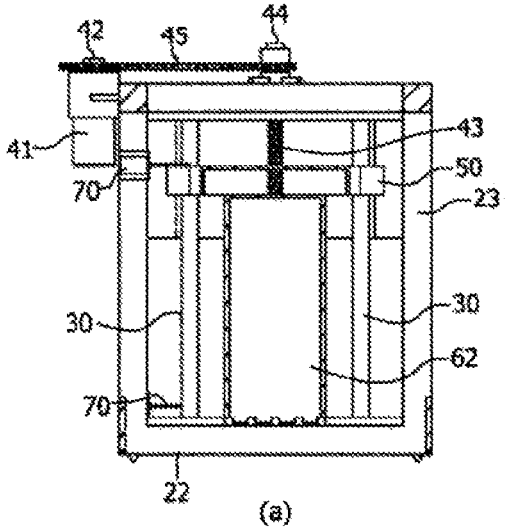
FIG. 6 includes cross-sectional views illustrating operational properties of a core drill apparatus according to an embodiment of the present invention.
Figure 6:
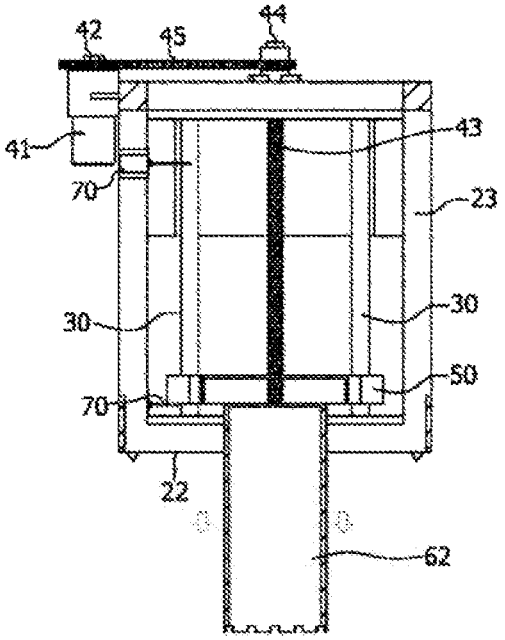
Figure 7:
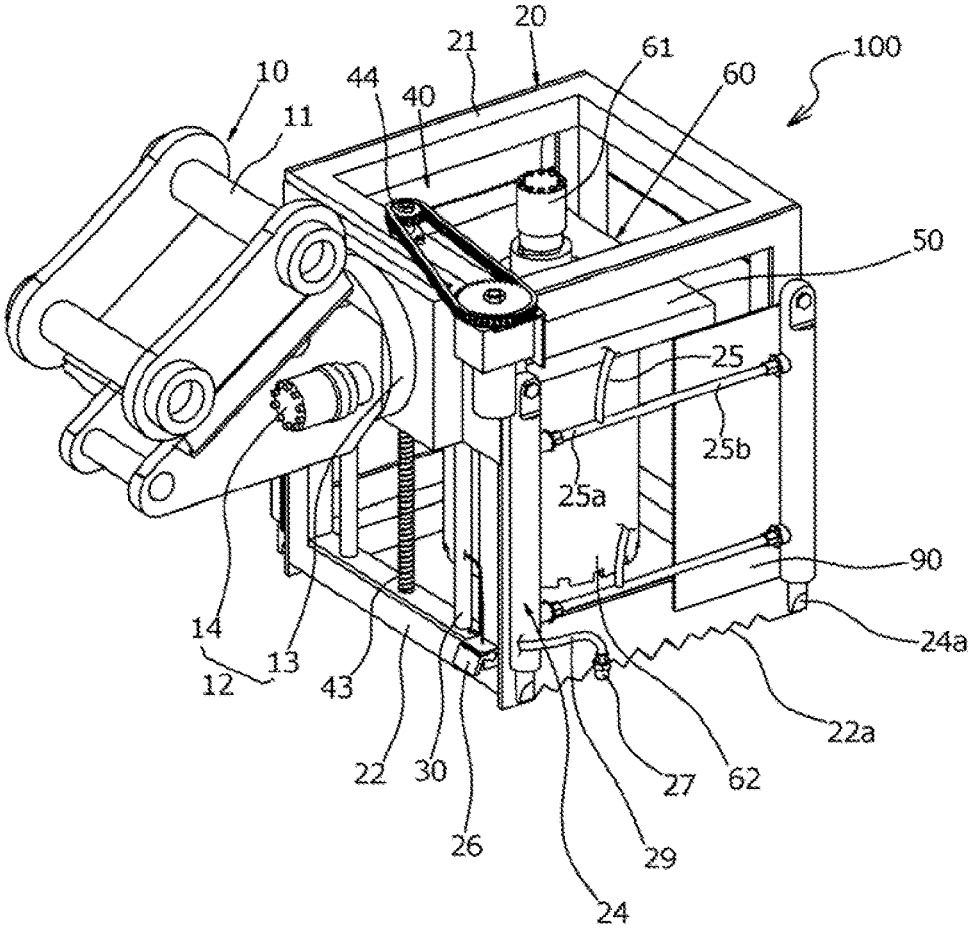
FIG. 7 is a perspective view illustrating schematically illustrating a core drill apparatus for installation in an excavator according to an embodiment of the present invention.
Figure 8:
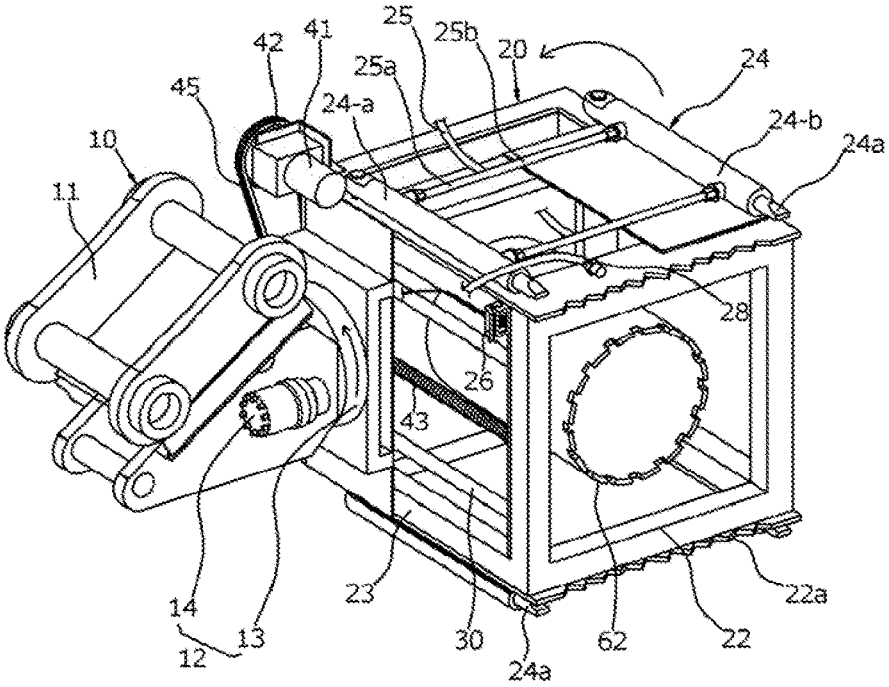
FIG. 8 is a view illustrating an operational state in which a support is rotated by the operation of a ring gear of a core drill apparatus for installation in an excavator according to an embodiment of the present invention.
Figure 9:
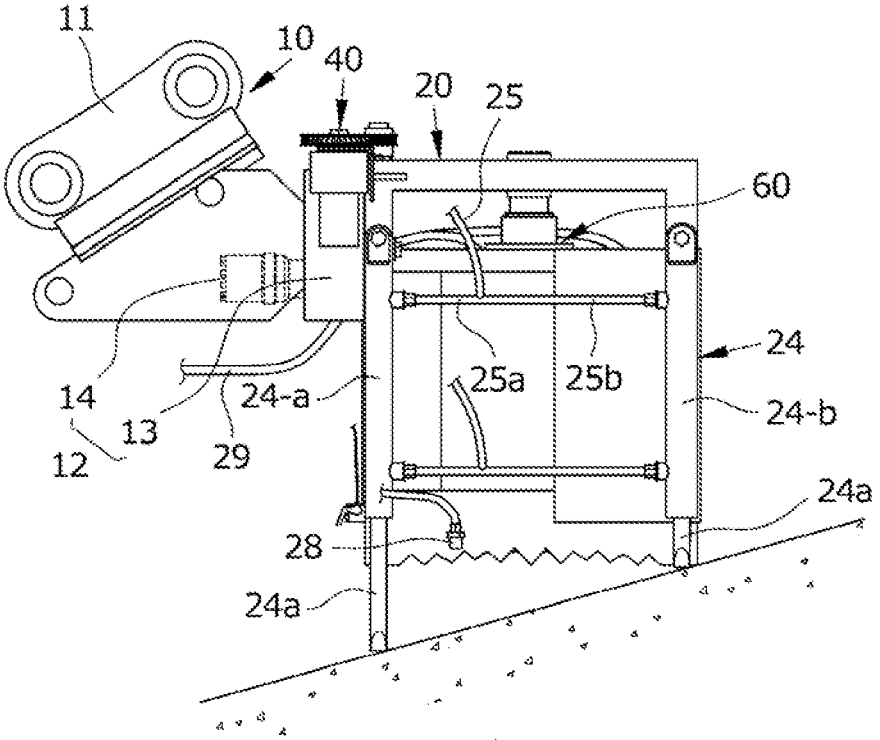
FIG. 9 is a view illustrating an operational state in which a support is supported on an inclined drilling surface by the operation of an elevation cylinder provided in a core drill apparatus for installation in an excavator according to an embodiment of the present invention.
Figure 9:
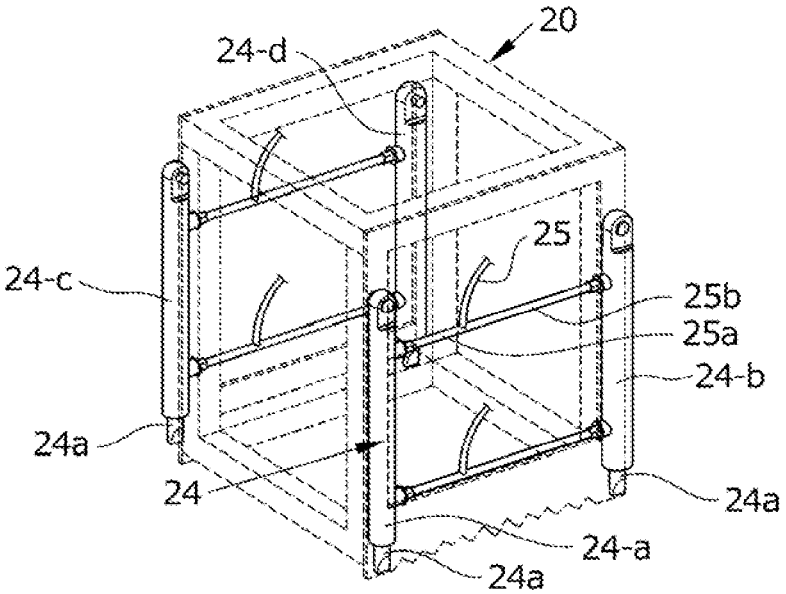
Figure 10:
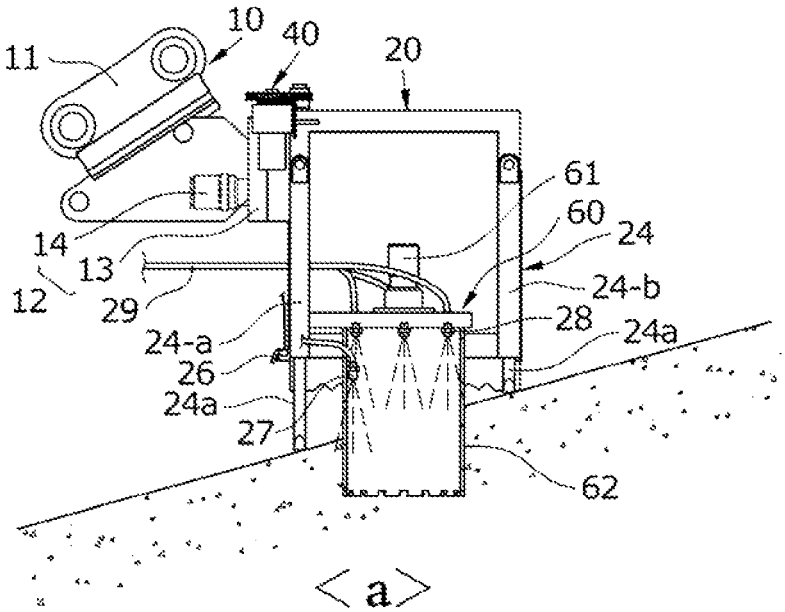
FIG. 10 is a view schematically illustrating an example in which water is sprayed to a drill bit by the operation of a spray provided in a core drill apparatus for installation in an excavator according to an embodiment of the present invention.
Figure 10:
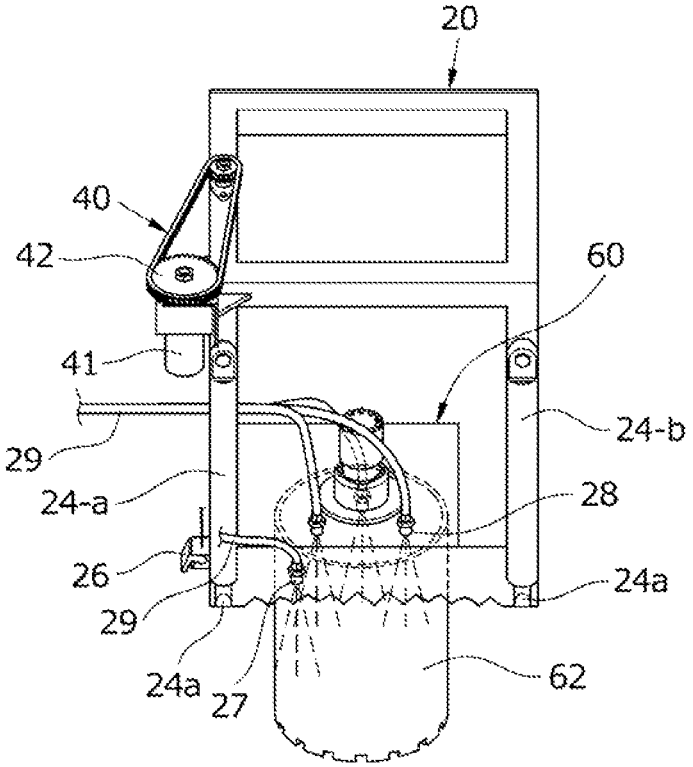

FIG. 6 includes cross-sectional views taken along line 1-1' of FIG. 4, illustrating operational properties of a core drill apparatus according to an embodiment of the present invention.

After the core drill apparatus 100 for installation in an excavator is installed to the excavator boom 2 as shown in FIG. 1, the rotational driving motor 61 is operated to rotate the drill bit 62 as shown in FIG. 6(*a*), and in this state, the elevation driving motor 41 is rotated at a preset rotational speed through the controller 81 of the control panel 80 to gradually descend the elevation block 50 in interoperation with the elevation driving motor 41 while drilling into the rock or concrete structure as shown in FIG. 6(*b*).

When the elevation block 50, which gradually descends while drilling into the rock or concrete structure, is stuck by the limit switch 70 provided at the lower portion of the supporting frame 23 as shown in FIG. 6(*b*), this circumstance is sensed in real-time by the controller 81, stopping the operation of the elevation driving motor 41. Thus, the elevation block 50 also stops descending, fundamentally preventing the elevation block 50 from excessively descending and being resultantly damaged.

In contrast, after drilling a hole in the rock or concrete structure, when the elevation block 50 is ascended in response to the operation of the elevation driving motor 41 and is then stuck by the limit switch 70 provided at the upper portion of the supporting frame 23 as shown in FIG. 6(*a*), this situation may be sensed by the controller 81, stopping the operation of the elevation driving motor 41. Accordingly, the elevation block 50 also stops ascending, fundamentally preventing the elevation block 50 from excessively ascending and being resultantly damaged.

The support 20 includes the upper frame 21, the lower frame 22, and the supporting frame 23 connecting the upper frame 21 with the lower frame 22. The support 20 further includes elevating cylinders 24 installed on the supporting frame 23 to allow the edges of the support 20 to be expanded or contracted according to the slope of the work surface of drilling and supported on the work surface.

The elevating cylinders 24 each are provided on the respective outer sides of the supporting frames 23 of the support 20. The number of the elevating cylinders 24 is four preferably, but is not limited thereto, and more or less elevating cylinders 24 may be installed depending on work environments or conditions.

Here, the elevating cylinder 24 may be configured of an actuator in which a cylinder rod 24*a* in its body is ascended or descended by an air pressure, hydraulic pressure, or electricity.

As an example, each elevating cylinder 24 is connected to a hydraulic hose 25 that is connected with a hydraulic pressure applier (not shown). The hydraulic pressure applier is typically provided in the operator's cab of the excavator.

Upon supporting the protrusions 22*a* formed in the bottom of the support 20 on the drilling work surface, if the drilling work surface is uneven to render the supporting hard, the drill bit 62 may be very difficult to operate.

At this time, the elevating cylinders 24, each installed on the respective edges of the support 20, is driven in which case the hydraulic pressure applier applies a hydraulic pressure to the upper-side hydraulic hose 25 so that the cylinder rod 24*a* provided inside the elevating cylinder 24 is descended to the supporting surface and is then supported on the work surface. If all of the elevating cylinders 24 provided on the edges of the support 20 are driven in such manner, each edge of the support 20 may stably be supported on the uneven supporting surface.

If the drill bit 62 is operated after the elevating cylinders 24 are driven to stably support the bottom of the support 20 on the drilling work surface, the drill bit 62 may perform drilling without shakes. Further, more durability may be secured for the drill bit 62.

As such, the drill bit 62 is driven to do drilling after the support 20 is stably supported on the drilling work surface using the elevating cylinders 24. After drilling, a hydraulic pressure is applied to the lower-side hydraulic line to ascend the cylinder rods 24 back to the original position.

To apply a hydraulic pressure to the elevating cylinders 24, each hydraulic hose 25 may be connected, as a single line, to their respective corresponding elevating cylinders 24, or each hydraulic hose 25 may connect two or more elevating cylinders 24 together.

A camera 26 may be installed in a lower side of the support 20 to enable the work surface of the drilling by the drill bit 62 to be viewed through a monitor screen (not shown) installed in the operator's cab of the excavator. A lighting device, e.g., a light emitting diode (LED), is provided around the lens of the camera.

As such, the camera 26 may be used to allow the work surface of the drilling performed by the drill bit 62 to be checked in the operator's cab, leading to enhanced work efficiency.

An operator (not shown) for operating the camera 26 may preferably be included in the controller 81.

An external spray 27 and an internal spray 28, respectively, are connected to a lower side of the support 20 and an upper surface of the drill bit 62 to jet water to the working surface where the drill bit 62 performs drilling.

In other words, the external spray 27 is provided in the lower side of the support 20 to jet water to its outside upon drilling by the drill bit 62, preventing dust from flying. The internal spray 28 is installed in the upper surface of the drill bit 62 which is shaped as a cylinder to jet water to its inside, preventing dust from flying or scattering inside the drill bit 62.

The external spray 27 and the internal spray 28 are connected to a water supplying line 29 to supply water from a water storage tank (not shown) provided at a side of the operator's cab of the excavator. A spraying device (not shown) may be provided in the water supplying line 29 to supply water from the water storage tank to the external spray 27 and the internal spray 28.

Three internal sprays 28 may be provided at 120-degree intervals on an upper surface of the drill bit 62 to jet water to the inside of the drill bit 62, but more or less internal sprays 28 may be provided given the position of installation or work conditions.

Multiple external sprays 27 each may be installed on each side surface of the support 20.

The external spray 27 and the internal spray 28 enables easier removal of, e.g., dust that flies over the surface where the drill bit 62 works, allowing for eco-friendly drilling work and easier check on the work from the operator's cab.

Here, an operator of the spraying device for operating the external spray 27 and the internal spray 28 is preferably included, provided, or installed in the controller 81.

Thus, where drilling work is performed on the horizontal floor surface, the support 20 is supported on the floor surface using the excavator boom 2, and the drill bit 62 is then descended while drilling into the floor surface.

In this case, when the drill bit 62 drills into the rock or concrete structure, dust floats around the drilling part. At this time, water is sprayed through the water supplying line 29, the external spray 27 and the internal spray 28 to the drilling part.

Thus, it is possible to prevent dust flying when drilling into the rock or concrete structure using the drill bit 62.

As such, the sprays provided inside and outside the drill bit and the camera with a lighting device enable the worker to do work while checking in real-time the working circumstance in the operator's cab, significantly raising work safety and environment and resultantly leading to better work efficiency.

When drilling is continuously performed on the wall surface which is formed perpendicular or inclined with respect to the floor surface after drilling into the floor surface is done, the ring gear driving motor 14 is operated to turn the support 20 at a desired angle, supporting the lower frame 22 on the vertical or inclined work surface.

An embodiment of the present invention is described in which four elevating cylinders 24-*a*, 24-*b*, 24-*c*, and 24-*d* are installed in their respective corresponding supporting frames 23.

In other words, in a case where the vertical or inclined work surface for drilling is uneven, the elevating cylinder 24-*a* of the elevating cylinders coupled to the four supporting frames 23 which correspond to edge parts of the support 20 is first operated. In this case, if a hydraulic pressure is applied from the hydraulic pressure applier to the upper hydraulic hose 25, and the cylinder rod 24*a* in the elevating cylinder 24-*a* is descended and supported on the work surface.

At this time, the plurality of hydraulic lines 25*a* and 25*b* branched from the hydraulic hose 25 are connected to their respective elevating cylinders to provide the hydraulic pressure to the elevating cylinders. A plurality of hydraulic hoses 25 are provided. By this configuration, the plurality of elevating cylinders 24 are simultaneously operated to ascend or descend. If a strong pressure is applied to any one of the elevating cylinders while the elevating cylinders are descended, the one elevating cylinder cannot further be descended while the other elevating cylinders keep on descending. As such, if the plurality of elevating cylinders all are applied with a pressure larger than the hydraulic pressure applied, they all stop descending and firmly contact the work surface.

Where the hydraulic hose 25 is branched into the hydraulic lines 25*a* and 25*b* is positioned not at a middle point between the elevating cylinders 24-*a* and 24-*b* but closer to any one thereof. The hydraulic line 25*b* which is longer in the distance between where the hydraulic hose 25 is branched and the elevating cylinder embeds a check valve (not shown). The check valve is opened when the hydraulic pressure is higher than the pressure at which the elevating cylinder descends, allowing the hydraulic pressure to be applied through the other hydraulic line 25*b* if the elevating cylinder 24-*a*, which is first descended, comes in contact with the work surface and is thus prevented from further descending. In such a manner, if the elevating cylinder 24-*b* descending is brought in contact with the work surface and is thus prevented from further descending, the check valve prevents the hydraulic pressure from being further applied.

The other elevating cylinders 24*c* and 24-*d* are also operated in such manner and are supported on the work surface.

As such, the elevating cylinders are descended by the hydraulic lines branched off one hydraulic hose not simultaneously but in such a manner that any one of the elevating cylinders is first descended, and if its descending is complete, another elevating cylinder is descended. Thus, the worker in the operator's cab may make sure that, after any one cylinder contacts the work surface, another is descended and brought in contact with the work surface regardless of the flatness or slope of the work surface. Thus, the worker may proceed to work while exactly checking his desired position and angle.

The elevating cylinders and the ring gear enable the drill bit to exactly be supported in tight contact with the work surface in a desired position and direction even when the work surface is inclined or uneven.

If the elevating cylinders, which are provided on the edge portions of the support 20, are all operated in such way, the edge portions of the support 20 may stably be supported on the supporting surface which is not even.

The camera 26 enables the worker to monitor the drilling work using the drill bit 62 through the monitor screen provided in the operator's cab, providing for further enhanced work convenience.

As described above, in the core drill apparatus for installation in an excavator according to the present invention, the ring gear and multiple elevating cylinders are connected and installed in the work supporting frame which is mounted to an end of the boom of the excavator to rotate the work supporting frame while adjusting the height on the inclined work surface using the elevating cylinders when the work supporting frame is supported on the inclined work surface. Thus, the drill bit 62 provided in the work supporting frame may stably drill into the structure regardless of the slope of the work surface on which the drilling is done, significantly enhancing the work efficiency of drilling.

According to the present invention, a camera may be installed in the work supporting frame having a drill bit formed therein, allowing the working process to be monitored in the operator's cab. Further, sprays are installed to jet water to the work surface of drilling, getting rid of dust when the drilling work proceeds. Thus, the drilling work may be done eco-friendly in a reduced time.

[Description of reference numbers]

| | |
|---|---|
| 100: core drill apparatus for installation in an excavator | |
| 1: excavator | 2: excavator boom |
| 3: operator's cab | 10: mount |
| 11: boom coupler | 12: rotational coupler |
| 13: ring gear | 14: ring gear driving motor |
| 20: support | 21: upper frame |
| 22: lower frame | 22a: protrusion |
| 23: supporting frame | 24: elevating cylinder |
| 24a: cylinder rod | 25: hydraulic hose |
| 25a, 25b: hydraulic line | 26: camera |
| 27: external spray | 28: internal spray |
| 29: water supplying line | 30: elevation guide pole |
| 40: elevator | 41: elevation driving motor |
| 42: main gear | 43: screw pole |
| 44: slave gear | 45: belt or chain |
| 50: elevation block | 60: drilling part |
| 61: rotational driving motor | 62: drill bit |
| 70: limit switch | 80: control panel |
| 81: controller | 82: power switch |
| 83: elevational direction adjusting switch | |
| 84: elevation speed adjusting switch | |
| 85: setting unit | 90: anti-flying debris cover |

What is claimed is:

1. A core drill apparatus for installation in an excavator, comprising:

a mount having a side portion detachably mounted on an end portion of a boom of the excavator;

a support mounted and fastened to an opposite side portion of the mount, including an upper frame, a lower frame, and supporting frames connecting the upper frame with the lower frame in an upper or lower direction, and formed in a rectangular box structure having, at least, an opened top and an opened bottom;

an elevator including a pair of elevation guide poles passing through the support and an elevation driving motor mounted on a side of the support, wherein the pair of elevation guide poles are provided in parallel with the supporting frames and have an upper portion coupled to the upper frame and a lower portion coupled to the lower fame;

an elevation block ascended or descended along the elevation guide poles by an operation of the elevation driving motor; and a drilling part including a rotational driving motor mounted in the elevation block and a drill bit coupled with a driving shaft of the rotational driving motor to be rotated by the rotational driving motor, wherein the mount includes a boom coupler formed in an end thereof to connect to the boom of the excavator and a rotational coupler formed in an opposite end thereof to rotatably connect to the support, wherein a plurality of elevating cylinders are coupled to their respective corresponding supporting frames of the support to be ascended or descended along an inclined surface of a work surface for drilling to be brought in tight contact with the work surface, wherein a plurality of hydraulic lines branched from a hydraulic hose are provided on the elevating cylinders, wherein the rotational coupler includes a ring gear enabling the support to rotate and a ring gear driving motor driving the ring gear to rotate forward or backward, and wherein an external spray is connected and provided under the support to jet water to an external work surface where the drill bit performs the drilling, and an internal spray is connected and provided on an upper surface of the drill bit to jet water to an internal work surface where the drill bit performs the drilling.

2. The core drill apparatus of claim 1, wherein a camera having a lighting device is provided under the support to allow the work surface into which the drill bit performs the drilling to be checked through a monitor screen installed in an operator's cab of the excavator.

3. The core drill apparatus of claim 1, wherein a point where the plurality of hydraulic lines are branched from the hydraulic hose is positioned closer to any one of the elevating cylinders and further away from another one of the elevating cylinders, and wherein a check valve is included in one of the hydraulic lines which is connected to the other elevating cylinder that is positioned further away from the point.

* * * * *